US005174356A

United States Patent [19]

VanderJagt

[11] Patent Number: 5,174,356

[45] Date of Patent: Dec. 29, 1992

[54] CASTING APPARATUS

[75] Inventor: A. Dean VanderJagt, Essexville, Mich.

[73] Assignee: General Motors Corporation, Detroit, Mich.

[21] Appl. No.: 877,275

[22] Filed: Apr. 29, 1992

Related U.S. Application Data

[63] Continuation of Ser. No. 732,606, Jul. 19, 1991, abandoned.

[51] Int. Cl.[5] ..... B22D 18/06

[52] U.S. Cl. ..... 164/255; 164/63

[58] Field of Search ..... 164/255, 63

[56] References Cited

U.S. PATENT DOCUMENTS

| | | | |
|---|---|---|---|
| 2,908,054 | 10/1959 | Wilkins . | |
| 2,991,518 | 7/1961 | Schaefer . | |
| 3,608,617 | 9/1971 | Burke | 164/126 |
| 3,825,058 | 7/1974 | Miura et al. | 164/253 |
| 4,340,108 | 7/1982 | Chandley et al. | 164/63 |
| 4,606,396 | 8/1986 | Chandley et al. | 164/255 |
| 4,733,714 | 3/1988 | Smith | 164/130 |
| 4,874,029 | 10/1989 | Chandley | 164/34 |
| 4,957,153 | 9/1990 | Chandley | 164/7.1 |
| 5,029,630 | 7/1991 | Voss | 164/255 |
| 5,038,846 | 8/1991 | Doty et al. | 164/58.1 |

FOREIGN PATENT DOCUMENTS

| | | | |
|---|---|---|---|
| 1-321063 | 12/1989 | Japan | 164/255 |

*Primary Examiner*—Kuang Y. Lin

*Attorney, Agent, or Firm*—Flynn, Thiel, Boutell & Tanis

[57] ABSTRACT

Casting apparatus for the vacuum-assisted casting of a melt includes a vacuum box defining a vacuum chamber and a gas permeable casting mold having a first mold portion confronted by the vacuum chamber and a second mold portion unconfronted by the vacuum chamber. The mold includes a mold cavity and a melt inlet that is disposed in the second mold portion for engaging a source of the melt and supplying the melt to the mold cavity. A refractory shield confronts the second mold portion and includes a melt-engaging portion having a melt inlet in melt flow communication with the melt inlet of the mold. A substantially gas impermeable seal is disposed between the refractory shield and the second mold portion for inhibiting ambient gas flow into the vacuum chamber when the vacuum chamber is evacuated during casting. The seal is protected by the refractory shield from heat from the melt when the melt-engaging portion of the refractory shield is engaged with the melt during casting.

23 Claims, 4 Drawing Sheets

CASTING APPARATUS

This is a continuation of copending application Ser. No. 07/732,606 filed on Jul. 19, 1991, now abandoned.

FIELD OF THE INVENTION

The present invention relates to apparatus for the vacuum-assisted, gravity or countergravity casting of a melt into a porous, gas permeable mold and, more particularly, to apparatus including a substantially gas impermeable seal disposed relative to a mold portion unconfronted by a vacuum chamber to inhibit ambient gas flow therethrough into the chamber during casting and a refractory shield disposed relative to the seal to protect it from heat from the melt during casting.

BACKGROUND OF THE INVENTION

Vacuum-assisted gravity casting apparatus using a porous, gas permeable casting mold confronted by a vacuum box are described in such prior art patents as the Wilkins U.S. Pat. No. 2,908,054; the Burke U.S. Pat. No. 3,608,617; and the Miura U.S. Pat. No. 3,825,058. The gas permeable mold typically includes an upper sprue exposed outside the vacuum box and through which the melt is gravity poured into the mold to fill the mold cavity therein. The vacuum box confronts the mold in a manner to permit evacuation of the mold cavity through the mold walls to not only remove gas (e.g., air) from the mold cavity that might otherwise be trapped in the casting produced therein but also to facilitate rapid, complete filling of the mold cavity with the melt. The relative vacuum is usually established in the mold cavity prior to and during filling of the mold cavity with the melt and may be discontinued once the mold cavity is completely filled.

Vacuum-assisted, countergravity casting apparatus using a porous, gas permeable casting mold confronted by a vacuum box are described in such prior art patents as the Chandley et al U.S. Pat. Nos. 4,340,108 and 4,606,396. Typically, the countergravity casting apparatus includes a mold having a porous, gas permeable upper cope and a lower drag sealingly secured together at a parting plane, a vacuum box confronting the gas permeable cope, and means for immersing (exposing) the underside of the drag in an underlying pool of melt. The vacuum box is evacuated sufficiently by a suitable vacuum pump while the drag underside is immersed in the pool to draw the melt upwardly through one or more ingate passages in the drag into one or more mold cavities formed between the cope and drag.

Typically, this countergravity casting process fills the mold cavities with the melt in a relatively short time, such as approximately 2–3 seconds. However, the mold must remain immersed in the melt until at least the melt in the ingate passages of the mold drag freezes off (solidifies). For example, the mold typically must remain immersed in the melt pool on the order of 15 to 50 seconds after filling of the mold cavity to freeze off (solidify) the melt in the ingate passages. In the event the mold is withdrawn from the melt pool prior to freezing of the melt in the ingate passages, the melt in the ingate passages as well as in the mold cavities can flow downwardly out of the mold and result in a defective casting which must be scrapped. The time required to freeze off the melt ingate passages has thus limited the rate of production of castings using this process.

In attempts at reducing the casting cycle time, prior art workers have tried disengaging the mold from the melt before the melt in the ingate passages is solidified while providing an increased vacuum level in the vacuum box sufficient to prevent the unsolidified melt from draining out of the ingate passages and mold cavities. However, as the level of the relative vacuum in the vacuum box is increased to this end, penetration of the porous mold by the melt (known as "burn-in") in upper mold regions proximate the vacuum source has been observed and resulted in production of defective castings which must be scrapped. "Burn-in" has been attributed to excessively high vacuum levels at upper mold regions as a result of their close proximity to the vacuum source; i.e., as a result of an increasing vacuum level gradient from the lower mold regions remote from the vacuum source to the upper mold regions proximate the vacuum source. Thus, difficulty has been experienced in providing a vacuum level at the drag ingate passages strong enough to hold the unsolidified melt therein during mold/melt disengagement without at the same time causing "burn-in" at other upper mold regions.

It is an object of the invention to provide an improved apparatus for the vacuum-assisted casting of a melt into a gas permeable mold having a first mold portion confronted by a vacuum box and a second mold portion unconfronted by the vacuum box wherein a substantially ga impermeable seal is cooperatively located relative to the second mold portion to inhibit ambient gas flow therethrough during casting and thereby improve the uniformity of the vacuum level achievable about the mold and wherein a refractory shield is cooperatively located relative to the seal for protecting it from heat from an underlying source of the melt during casting.

It is another object of the invention to provide an improved apparatus for the vacuum-assisted, gravity casting of a melt into a gas permeable mold wherein a substantially gas impermeable seal and associated protective refractory shield are cooperatively disposed relative to a mold portion unconfronted by a vacuum box so as to provide a more uniform vacuum level about the mold during filling of the mold with the melt.

It is still another object of the invention to provide an improved apparatus for the vacuum-assisted, countergravity casting of a melt into a gas permeable mold wherein a substantially gas impermeable seal and associated protective refractory shield are cooperatively disposed relative to a lower mold portion unconfronted by a vacuum box so as to achieve a strong enough vacuum level at the lower mold ingate passages to hold unsolidified melt therein to permit early mold/melt disengagement before melt solidification, and thus reduced casting cycle times, without at the same time experiencing "burn-in" at other upper mold regions.

SUMMARY OF THE INVENTION

The present invention contemplates a casting apparatus for the vacuum-assisted casting of a melt wherein the apparatus comprises a vacuum box defining a vacuum chamber and a gas permeable mold having a first mold portion confronted by the vacuum chamber and a second mold portion unconfronted by the vacuum chamber. The mold includes a mold cavity and a melt inlet that is disposed in the second mold portion for supplying the melt to the mold cavity.

A refractory shield confronts the second mold portion and includes a melt-engaging portion having a melt inlet in melt flow communication with the melt inlet of the mold. The refractory shield can be configured to locate the mold in a casting position wherein the melt inlet of the mold is registered in communication with the melt inlet of the refractory shield. For example, the refractory shield can be configured to locate a plurality of molds in an annular casting array with the melt inlet of each mold registered in communication with a respective melt inlet of the refractory shield.

A substantially gas impermeable seal is disposed between the refractory shield and the second mold portion for inhibiting ambient gas flow therethrough into the vacuum chamber when the vacuum chamber is evacuated by suitable means, such as a vacuum pump. The seal is protected from thermal degradation from heat from the melt by the refractory shield when the melt-engaging portion is engaged with the melt for casting.

In one embodiment of the invention, the seal comprises a substantially gas-impermeable layer disposed on the refractory shield or on the mold so as to confront the second mold portion.

In another embodiment of the invention, the vacuum box includes an end wall and a peripheral wall defining a first chamber. The refractory shield includes an end wall and a peripheral wall sealingly engaged to the peripheral wall of the vacuum box and defining a second chamber confronting the first chamber. The first and the second chambers form a mold-receiving chamber between the vacuum box and the refractory shield. The thermally degradable seal is disposed between the refractory shield and the mold to inhibit ambient gas flow into the mold-receiving chamber during casting when the vacuum box is evacuated.

In still another embodiment of the invention for vacuum-assisted, countergravity casting of a melt, the vacuum box is disposed above the refractory shield such that the melt-engaging portion of the refractory shield is engageable with an underlying source of the melt for countergravity casting of the melt upwardly into the mold cavity when a sufficient vacuum is established in the vacuum box. The mold may be supported on the refractory shield with the upper mold portion received in the vacuum box.

In still a further embodiment of the invention for vacuum-assisted gravity casting of a melt, the vacuum box is disposed below the refractory shield such that the melt-engaging portion of the refractory shield is engageable with an overlying source of the melt for gravity casting the melt into the mold cavity. The melt-engaging portion may be configured as a pour basin for receiving the melt for supply to the mold therebelow via one or more down sprues.

BRIEF DESCRIPTION OF THE DRAWINGS

The objects and advantages of the present invention enumerated above will become more readily apparent from the following detailed description taken in conjunction with the following drawings.

DETAILED DESCRIPTION OF THE INVENTION

Figure 1:
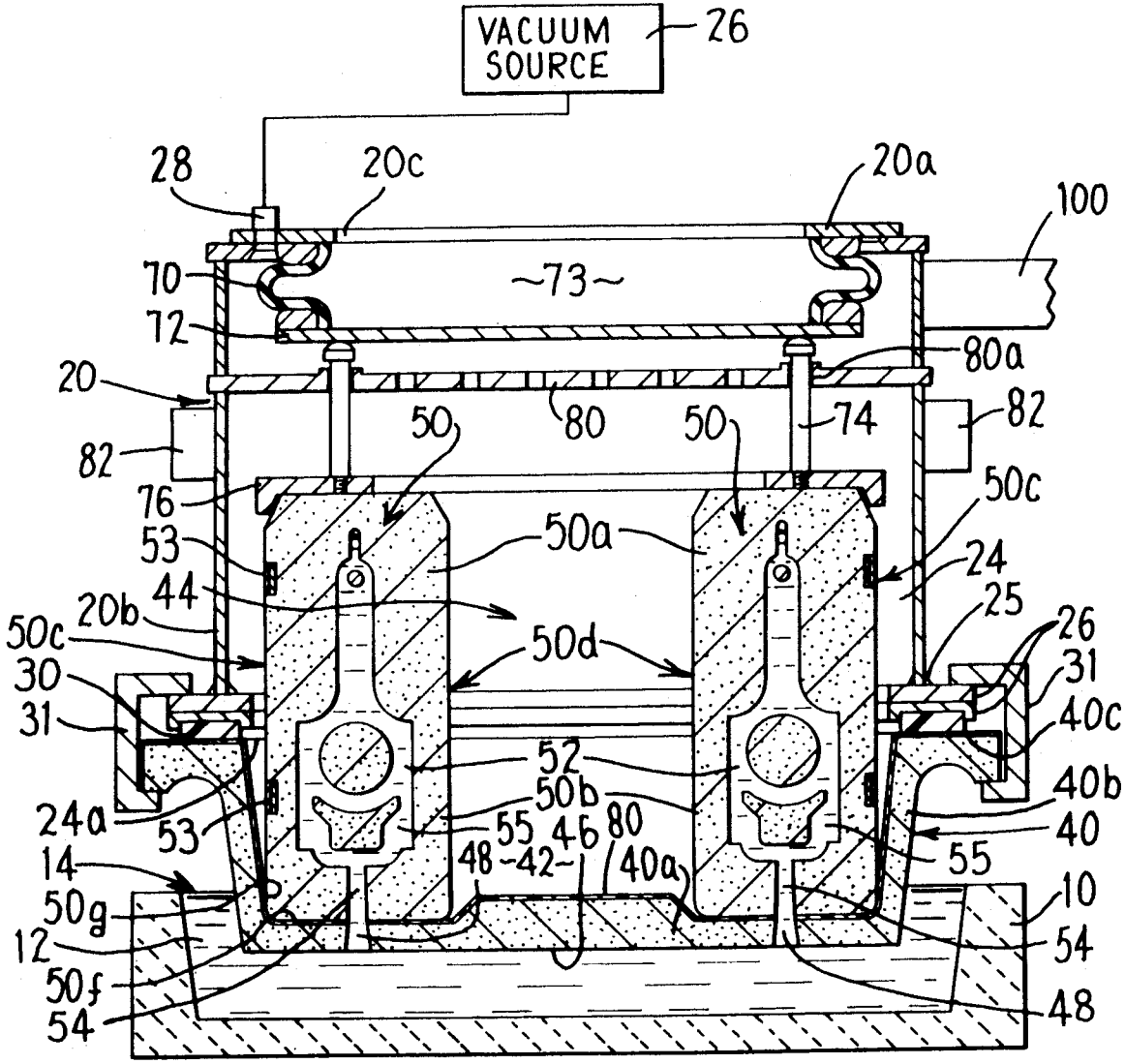
FIG. 1 is a side sectional view of a casting apparatus in accordance with one embodiment of the invention.

FIG. 1 illustrates a casting apparatus in accordance with one embodiment of the invention for the vacuum-assisted, countergravity casting of a melt 12 (e.g., molten metal) contained in a vessel 10 (e.g., a crucible) as a melt pool 14. The casting apparatus includes a vacuum box 20 having a top end wall **20*a* and a peripheral wall 20*b* defining a vacuum chamber 24. A lower lip 25 of the peripheral wall 20*b* includes seal support members 26 fastened thereto so as to form a mouth 24*a* of the vacuum chamber 24. A peripheral sealing gasket 30 is fastened to the lower support member 26. The vacuum chamber 24 is communicated to a source of vacuum 26 (e.g., a vacuum pump) by a conduit 28 sealingly fastened to the top end wall 20*a* of the vacuum box 20**.

A self-supporting, resin-bonded sand refractory shield 40 is sealingly engaged to the peripheral wall **20*b* of the vacuum box 20 via the sealing gasket 30. The refractory shield 40 comprises a lower end wall 40*a* and an upstanding peripheral wall 40*b* having an upwardly facing lateral flange 40*c* for engaging the sealing gasket 30 as shown. The refractory shield 40 is held in sealing engagement with the vacuum box 20 by one or more clamps 31** (two shown).

The refractory shield 40 defines a chamber 42 confronting the vacuum chamber 24 such that a mold-receiving chamber 44 is formed between the vacuum box 20 and the refractory shield 40. The refractory shield includes a melt-engaging portion 46 adapted to be immersed (engaged) in the melt pool 14 and a plurality of circumferentially spaced melt inlets 48 for communicating the melt-engaging portion 46 to the mold-receiving chamber 44.

The refractory shield 40 can be made of resin-bonded foundry sand in accordance with known mold practice wherein a compliant mixture of foundry sand or equivalent particles and a settable bonding material (e.g., an inorganic or organic thermal or chemical setting plastic resin) is formed to shape and cured or hardened against respective contoured pattern plates (not shown) having the desired contour or profile for forming the features shown. The refractory shield 40 may be made of other refractory material, such as high temperature ceramic, so as to render it reusable.

A plurality of porous, gas permeable molds 50 (two shown) are disposed in the mold-receiving chamber 44 and held together in an annular array by lower and upper straps 53 therearound. As is apparent in FIG. 1, the upper portions **50*a* of the molds are confronted by the vacuum chamber 24 whereas the lower portions 50*b* are located outside the vacuum chamber 24 (i.e., unconfronted by the vacuum chamber 24). The lower mold portions 50*b* instead are confronted by the refractory shield 40. Both the outer and inner mold peripheries 50*c*, 50*d* are subjected to a relative vacuum established in the chamber 44**.

Each mold 50 includes a mold cavity 52 and an optional auxiliary cavity 55 for receiving the melt 12 as well as a melt inlet 54 registered above and communicating with the melt inlet 48 of the refractory shield 40 for admitting the melt to the cavities 52, 55. The molds 50 can be made of resin-bonded foundry sand in the manner described above and may be adhesively secured together at juxtaposed parting planes between adjacent molds 50.

The chamber 42 of the refractory shield 40 is configured to locate the molds 50 in a manner that each melt inlet 54 thereof is registered in flow communication with a respective melt inlet 48 of the refractory shield 40. The molds 50 are supported on the end wall 40*a* of the refractory shield 40 and biased thereagainst by a biasing mechanism including a flexible bladder 70 and associated plate 72 that together define a upper chamber 73 communicated to atmospheric or ambient pressure via central opening 20*c* in the top end wall 20*a* of the vacuum box. The plate 72 engages a plurality of circumferentially spaced apart pins 74 (two shown) screwed into an annular lower plate 76 that, in turn, engages the upper portions 50*a* of the molds 50 as shown. The pins 74 are disposed in suitable openings 80*a* of an apertured intermediate plate 80 fixed (e.g. welded) on the vacuum box peripheral wall 20*b*. When the vacuum chamber 24 is evacuated by the vacuum source 26 during countergravity casting, atmospheric (ambient) pressure in the upper chamber 73 biases the plate 72, pins 74 and plate 76 downwardly to, in turn, bias the molds 50 toward the lower end wall 40*a* of the refractory shield 40.

A substantially gas impermeable seal layer 80 is disposed between the refractory shield 40 and the molds 50; e.g., on the lower end wall 40*a* and the peripheral wall 40*b* of the refractory shield 40. The seal layer 80 extends to and is sealingly engaged by the sealing gasket 30 so as to inhibit ambient (e.g., air) flow into the mold-receiving chamber 44 through the lower mold portions 50*b* when the vacuum chamber 24 is evacuated. Inhibition of ambient gas flow through the lower mold portions 50*b* into the chamber 44 improves the uniformity of the uniform vacuum level provided in the chamber 44 about the molds 50; i.e., reduces vacuum level gradients in the chamber 44 from the bottom to the top thereof. The beneficial result is that a strong enough vacuum level can be established at the melt inlets 48, 54 to permit the refractory shield 40 to be disengaged from the melt 12 after filling of the mold cavities 52 and prior to melt solidification in the melt inlets 48, 54 without runout of the melt 12 therefrom so as to yield a substantial reduction in casting cycle time. Moreover, the strong vacuum level can be achieved at the lower mold portions 50*b* (at the melt inlets 48,54) without an excess vacuum level being established at the upper mold portions 50*a* that could cause "burn-in" of the mold and the production of defective castings.

Figure 2:
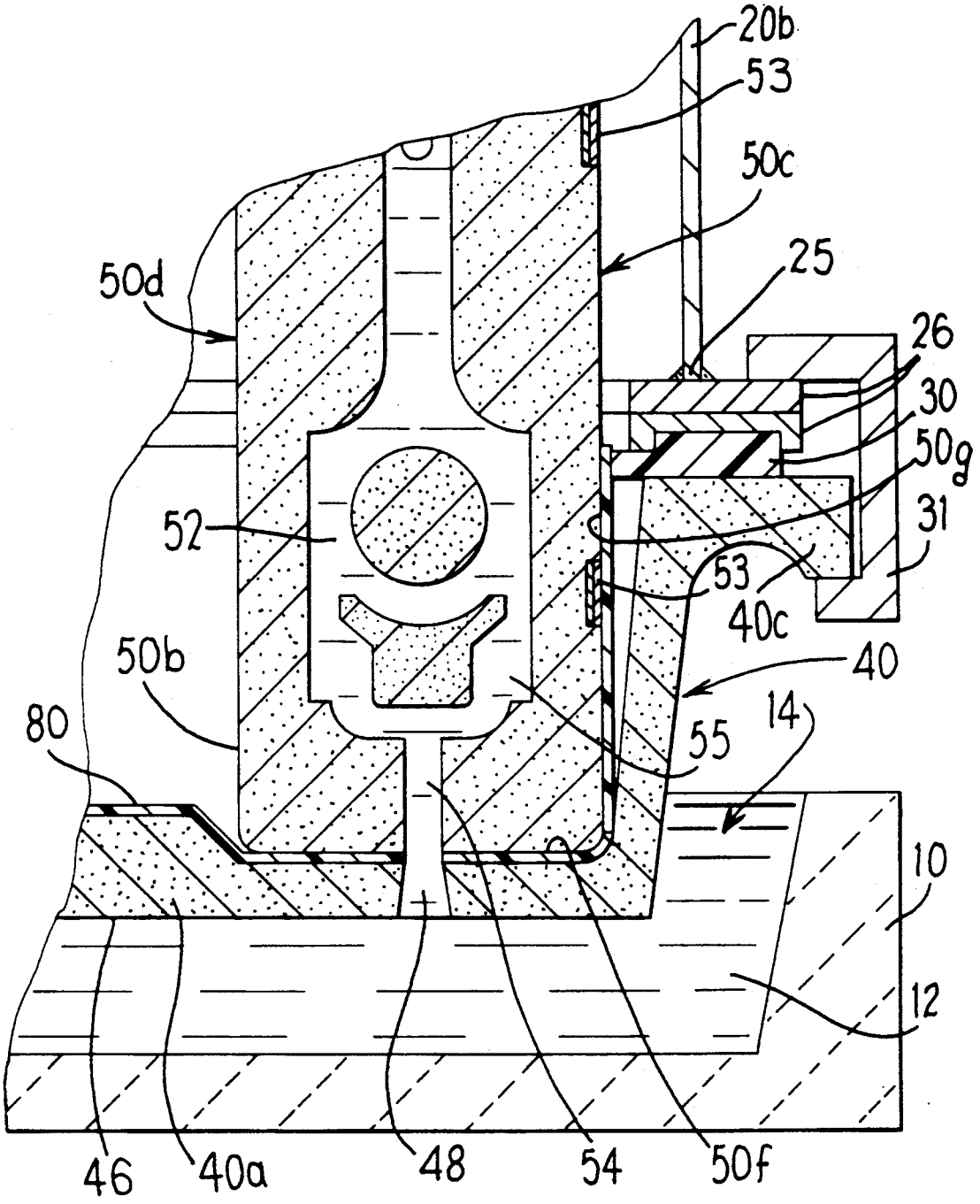
FIG. 2 is a fragmentary side sectional view of the casting apparatus in accordance with another embodiment of the invention.

Although the seal layer 80 is described as being disposed on the end wall 40*a* and the peripheral wall 40*b* of the refractory shield 40, the invention is not so limited. For example, the seal layer 80 may be disposed on the end wall 40*a* of the refractory shield 40 and on the mold peripheral walls 50*g* to the height of the sealing gasket 30, FIG. 2. The sealing gasket 30 can be extended inwardly to sealingly engage the seal layer 80 on the mold peripheral walls 50*g*, as shown in FIG. 2.

The seal layer 80 typically comprises a thermally degradable, substantially gas impermeable paint or sealant applied to the refractory shield 40 and/or molds 50 by dipping, spraying, brushing, and the like. A particular sealing layer for use in practicing the invention comprises latex paint. Alternately, the seal layer 80 may comprise a film or layer of substantially gas impermeable material, such as plastic sheet, aluminum foil or other substantially gas impermeable flexible sheet material.

Referring to FIG. 1, vacuum-assisted, countergravity casting of the melt 12 into the molds 50 is effected by relatively moving the vacuum box 20/refractory shield 40 and the pool 14 to immerse the melt-engaging portion 46 in the melt 12. Typically, the vacuum box 20 is lowered toward the pool 14 via an arm 100 fastened thereon and a hydraulic power cylinder (not shown) connected to the arm 100 as described in U.S. Pat. No. 4,340,108. The vacuum chamber 24 is then evacuated sufficiently to draw the melt 12 upwardly through the melt inlets 48,54 into the cavities 52,55 to fill them with the melt 12.

After the mold cavities 52 are filled with the melt 12 and before the melt 12 in the inlets 48,54 and the mold cavities 52 is solidified, the vacuum box 20/refractory shield 40 are raised by the arm 100 with the relative vacuum maintained in the chamber 24 to disengage the melt-engaging portion 46 from the melt 12. The melt 12 in the inlets 48,54 is held therein against gravity induced runout by the vacuum level at the inlets.

In this way, the refractory shield 40 needs to be immersed in the pool 14 only long enough to fill the mold cavities 52 with the melt 12 and need not remain immersed in the pool 14 until the melt 12 in the inlets 48,54 and the cavities 52,55 is solidified. As a result, a significant reduction in the overall casting cycle time is achieved. Moreover, the improvement in uniformity of the vacuum level in the chamber 44 avoids "burn-in" at the upper mold regions 50*a* and the production of defective castings. The refractory shield 40 protects the seal layer 80 from thermal degradation from heat from the melt pool 12 during casting.

After the withdrawal of the refractory shield 40 from the pool 14, the vacuum box 20/refractory shield 40 can be inverted about the trunnions 82 by a suitable manual or rotary actuator (not shown) so that the melt 12 can solidify in the inverted molds 50. When the vacuum box 20/refractory shield 40 are inverted, the auxiliary cavities 55 function as a source of melt 12 that can be supplied to the associated mold cavity 52 to accommodate melt shrinkage as the melt solidifies.

Figure 3:
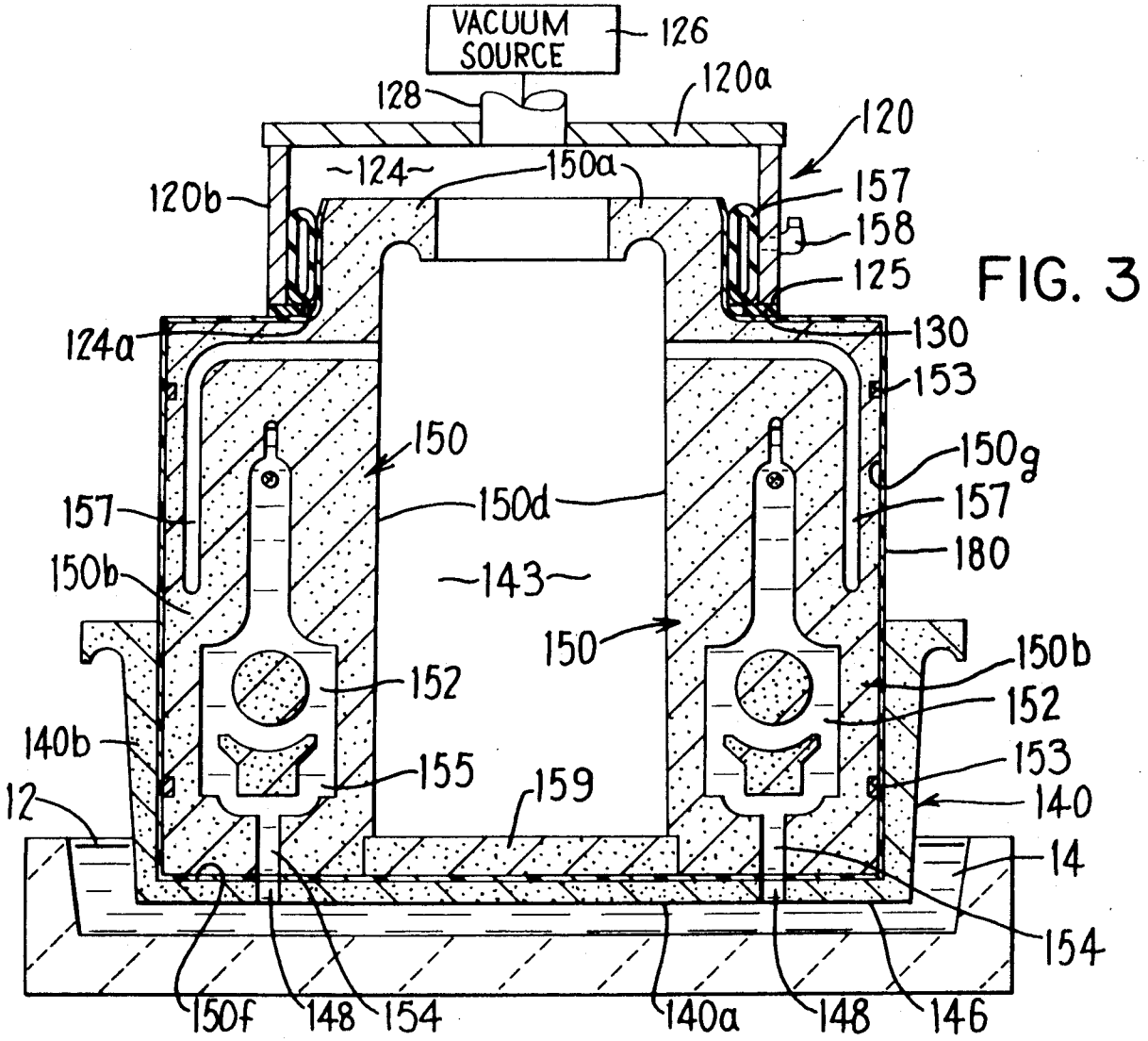
FIG. 3 is a side sectional view of a casting apparatus in accordance with still another embodiment of the invention.

FIG. 3 illustrates a vacuum-assisted, countergravity casting apparatus in accordance with another embodiment of the invention wherein the apparatus includes a vacuum box 120 having a top end wall 120*a* and a peripheral wall 120*b* defining a vacuum chamber 124 and a lower lip 125. The lower lip 125 forms a mouth 124*a* of the vacuum chamber 124 and carries an annular peripheral sealing gasket 130. The vacuum chamber 124 is communicated to a source of vacuum 126 (e.g., a vacuum pump) by a conduit 128 sealingly fastened to the top wall 120*a* of the vacuum box 120.

A plurality of porous, gas permeable molds 150 are held in an annular array by lower and upper straps 153 therearound. The molds 150 are sealingly engaged to the vacuum box 20 by an annular air clamp 157 that is pressurized with air via fitting 158 connected to a suitable air pressure source (not shown). As is apparent in FIG. 3, only the upper narrow neck portions 150*a* of the molds are confronted by the vacuum chamber 124 whereas the lower enlarged portions 150*b* are located outside the vacuum chamber 124 (i.e., unconfronted by the vacuum chamber 124).

Each mold 150 includes a mold cavity 152 and an optional auxiliary cavity 155 for receiving the melt 12 and a melt inlet 154 registered above and communicating with the melt inlet 148 of the refractory shield 140 for admitting the melt to the cavities 152, 155.

The inner peripheries 150*d* of the molds 150 define an inner vacuum passage 143 that is subjected to the relative vacuum established in the vacuum chamber 124. Each mold 150 includes a vacuum passage 157 that extends from the inner passage 143 laterally and downwardly about each mold cavity 152 to facilitate filling them with the melt 12. A refractory spacer 159 is disposed at the bottom of the inner passage 143.

A substantially gas impermeable seal layer 180 of the type described above is disposed on the mold end walls 150*f*, the mold peripheral walls 150*g* as well as on the underside of the refractory spacer 159. The seal layer 180 extends to the upper mold portions 150*a* where it is sealingly engaged by the sealing gasket 130 so as to inhibit ambient (e.g., air) flow into the chamber 124 and passages 143, 157 through the lower mold portions 150*b* when the chamber 124 is evacuated.

The refractory shield 140 confronts the sealed mold end walls 150*f* and portions of the sealed peripheral walls 150*g*. To this end, the refractory shield includes a lower end wall 140*a* confronting the mold end walls 150*f* and an upstanding peripheral wall 140*b* confronting portions of the mold peripheral walls 150*g*. As is apparent, the seal layer 180 is exposed at regions on the molds 150 unconfronted by the vacuum chamber 120 and the refractory shield 140. The refractory shield 140 is held in engagement with the mold end walls and peripheral walls 150*f*, 150*g* by suitable clamps (not shown) or adhesive. The refractory shield 140 may be formed (molded) in-situ about the sealed mold walls 150*f*, 150*g*.

The refractory shield 140 includes a melt-engaging portion 146 adapted to be immersed (engaged) in the melt pool 14 and a plurality of circumferentially spaced melt inlets 148 for communicating the melt-engaging portion 146 to the cavities 152, 155 via mold inlets 154.

The seal layer 180 inhibits ambient gas flow into the vacuum chamber 124 and passages 143, 157 through the lower mold portions 150*b*. The beneficial result is that a strong enough vacuum level can be established at the melt inlets 148, 154 to permit the refractory shield 140 to be disengaged from the melt 12 after filling of the mold cavities 152, 155 and prior to melt solidification in the melt inlets/passages 148, 154 so as to yield a substantial reduction in casting cycle time. This vacuum level can be obtained at the inlets 148, 154 while avoiding an excess vacuum level that could cause "burn-in" at upper regions of the mold cavities and the production of defective castings.

Figure 4:
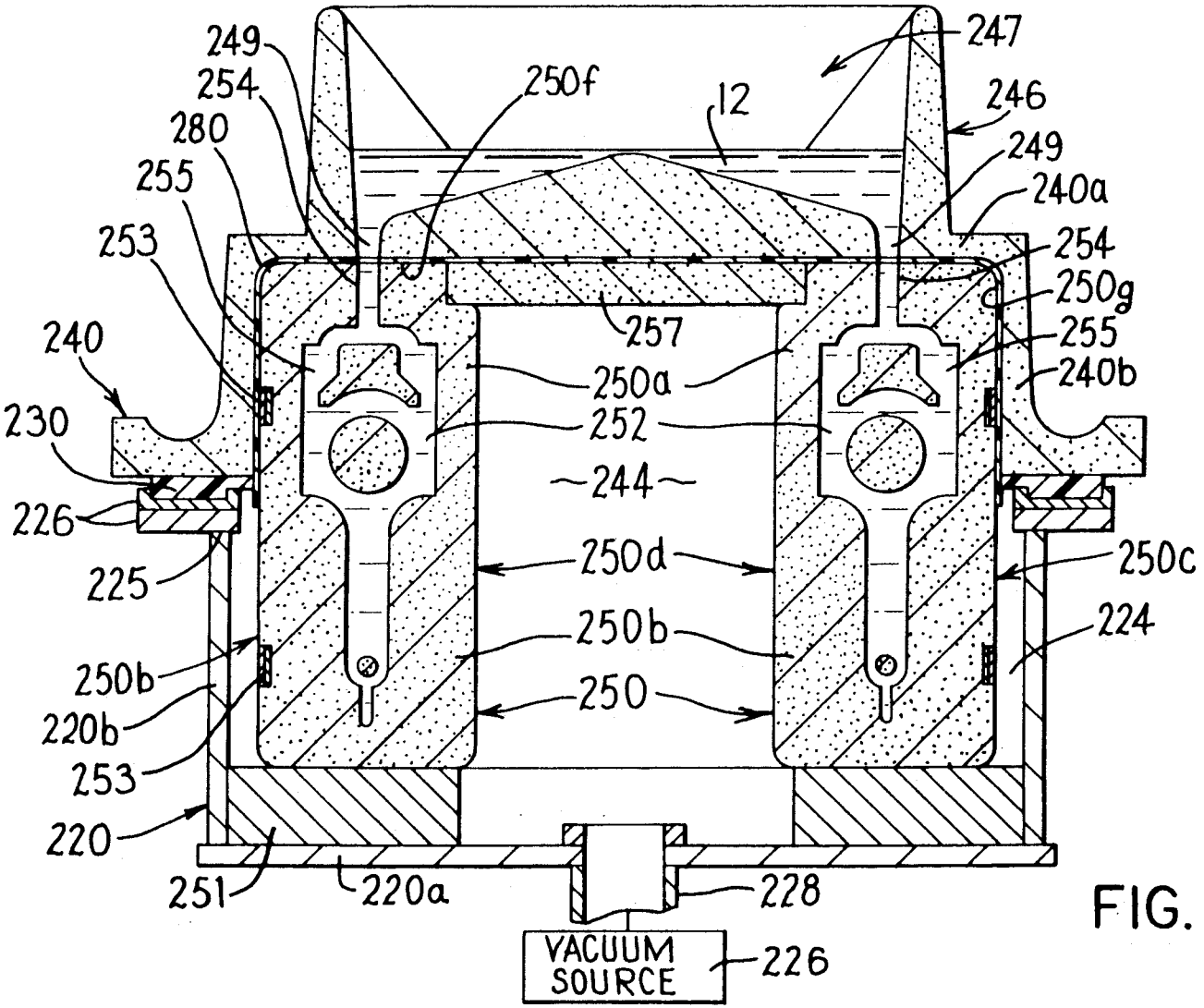
FIG. 4 is a side sectional view of a casting apparatus in accordance with yet another embodiment of the invention.

FIG. 4 illustrates a vacuum-assisted, gravity casting apparatus in accordance with still another embodiment of the invention wherein the apparatus includes a vacuum box 220 having a bottom end wall 220*a* and an upstanding peripheral wall 220*b* defining a vacuum chamber 224 and an upper lip 225. Seal support members 226 are fastened to the upper lip 225 and carry a peripheral sealing gasket 230. The vacuum chamber 224 is communicated to a source of vacuum 226 (e.g., a vacuum pump) by a conduit 228 sealingly fastened to the bottom wall 220*a* of the vacuum box 220.

A plurality of porous, gas permeable molds 250 are held in an annular array by lower and upper straps 253 therearound and are supported in the vacuum chamber 224 by an annular support plate 251. The upper mold portions 250*a* are unconfronted by the vacuum chamber 224 whereas the lower mold portions 250*b* are confronted thereby. Both the outer and inner mold peripheries 250*c*, 250*d* are subjected to a relative vacuum established in the mold-receiving chamber 244 that is defined between the vacuum chamber 224 and the refractory shield chamber 244. The refractory shield 240 and the vacuum box 220 are sealingly engaged by the annular sealing gasket 230.

Each mold 250 includes a mold cavity 252 and an optional auxiliary cavity 255 for receiving the melt 12 and a melt inlet 254. A refractory spacer 257 is disposed on the molds 250 at the top of the chamber. 244.

The refractory shield 240 includes an upper end wall 240*a* confronting the mold end walls 250*f* and a depending peripheral wall 240*b* confronting the mold peripheral walls 250*g*.

A substantially gas impermeable seal layer 280 of the type described above is disposed between the refractory shield 240 and the mold end walls 250*f*, the mold peripheral walls 250*g* as well as on the top of the refractory spacer 257. The seal layer 280 extends to the sealing gasket 230 so as to inhibit ambient (e.g., air) flow into the chamber 244 through the upper mold portions 250*a*.

The refractory shield 240 includes a melt-engaging portion 246 configured as an upwardly facing pour basin 247 for receiving melt 12 poured therein from a crucible, ladle, or other melt-containing vessel (not shown). The pour basin 247 includes a plurality of circumferentially spaced melt outlets 249 registered above and communicating with a respective melt inlet 254 of each mold 250 for supplying the melt 12 to the cavities 252, 255. Prior to and during mold filling, the vacuum chamber 224 is evacuated by the source 226 to remove gas (e.g., air) from the cavities 252, 255 to prevent gas entrapment in the castings produced therein and to facilitate rapid, complete filling of the cavities with the melt 12. As the melt solidifies in each mold cavity 252, the auxiliary cavity 255 supplies the melt thereto to accommodate melt shrinkage in the mold cavity 252.

While the invention has been described in terms of specific embodiments described in detail above, it is not intended to be limited thereto but rather only to the extent set forth hereafter in the claims which follow.

I claim:

1. Casting apparatus, comprising:

a) a vacuum box defining a vacuum chamber, b) a gas permeable mold having a first mold portion confronted by said vacuum chamber and a second mold portion unconfronted by said vacuum chamber, said mold having a mold cavity and a melt inlet that is disposed in the second mold portion for supplying the melt to the mold cavity, c) a refractory shield confronting the second mold portion and including a melt-engaging portion having a melt inlet in melt flow communication with the melt inlet of the mold, d) a substantially gas impermeable seal disposed between the refractory shield and the second mold portion for inhibiting ambient gas flow into the vacuum chamber when said vacuum chamber is evacuated, said refractory shield protecting said seal from thermal degradation from the heat from the melt when the melt-engaging portion is engaged therewith for casting the melt into the mold cavity, and e) means for evacuating the vacuum chamber when the melt-engaging portion and the melt are engaged for casting so as to urge the melt to fill the mold cavity.

2. The apparatus of claim 1 wherein the refractory shield comprises resin-bonded refractory particulates.

3. The apparatus of claim 1 wherein the seal comprises a substantially gas-impermeable layer disposed on the refractory shield.

4. The apparatus of claim 1 wherein the seal comprises a substantially gas impermeable layer disposed on the mold.

5. The apparatus of claim 1 wherein the vacuum box is disposed above the refractory shield such that the melt-engaging portion is engageable with an underlying source of the melt for countergravity casting of the melt into the mold cavity.

6. The apparatus of claim 5 wherein the mold is supported on the refractory shield.

7. The apparatus of claim 1 wherein the vacuum box is disposed below the refractory shield such that the melt-engaging portion is engageable with an overlying source of the melt for gravity casting into the mold cavity.

8. The apparatus of claim 7 wherein the melt-engaging portion is configured as a pour basin for receiving the melt.

9. The apparatus of claim I wherein the refractory shield is configured to locate the mold in a casting position wherein the melt inlet of said mold is registered in communication with the melt inlet of said refractory shield.

10. The apparatus of claim 1 wherein the refractory shield is configured to locate a plurality of molds with the melt inlet of each mold registered in communication with a respective melt inlet of the refractory shield.

11. The apparatus of claim 1 further comprising means for clamping the vacuum box and the refractory shield together.

12. The apparatus of claim 1 wherein the refractory shield is molded in-situ about the second mold portion.

13. Casting apparatus, comprising:

a) a vacuum box having an end wall and a peripheral wall defining a first chamber, b) a refractory shield having an end wall and a peripheral wall sealingly engaged to the peripheral wall of the vacuum housing and defining a second chamber confronting said first chamber so as to form a mold-receiving chamber between said box and said refractory shield, said refractory shield having a melt-engaging portion and a melt inlet for communicating the melt-engaging portion to the mold-receiving chamber, c) a gas permeable mold disposed in the mold-receiving chamber, said mold having a mold cavity for receiving the melt and a melt inlet communicating with the melt inlet of said refractory shield for admitting the melt to the mold cavity, d) a substantially gas impermeable seal disposed between the refractory shield and the mold for inhibiting ambient gas flow into the mold-receiving chamber when said mold-receiving chamber is evacuated, said refractory shield protecting said seal from thermal degradation from the heat from said melt when the melt-engaging portion is engaged therewith for casting the melt into the mold cavity, and e) means for evacuating the mold-receiving cavity when the melt-engaging portion and the melt are engaged for casting so as to urge the melt to fill the mold cavity.

14. The apparatus of claim 13 wherein the vacuum box defines an upper first chamber and the refractory shield defines a lower second chamber such that the melt-engaging portion of said refractory shield faces an underlying source of the melt for engagement therewith to countergravity cast the melt into the mold cavity when said melt-engaging portion and the source are engaged with the mold-receiving chamber evacuated.

15. The apparatus of claim 14 wherein the mold is supported on the end wall of the refractory shield.

16. The apparatus of claim 13 wherein the vacuum box defines a lower first chamber and the refractory shield wall defines an upper second chamber, said melt-engaging portion of said refractory shield forming an upper pour basin for receiving melt from a source for gravity casting of the melt into the mold cavity as assisted by evacuation of the mold-receiving chamber.

17. The apparatus of claim 13 wherein the second chamber of the refractory shield is configured to locate the mold in a casting position wherein the melt inlet of said mold is registered in communication with the melt inlet of said refractory shield.

18. The apparatus of claim 13 wherein the second chamber of the refractory shield is configured to locate a plurality of molds with the melt inlet of each mold registered in communication with a respective melt inlet of the refractory shield.

19. The apparatus of claim 13 wherein the refractory shield comprises resin-bonded refractory particulates.

20. The apparatus of claim 13 wherein the seal comprises a substantially gas-impermeable layer disposed on the end wall and peripheral wall of the refractory shield.

21. The apparatus of claim 13 wherein the seal comprises a substantially gas-impermeable layer disposed on the end wall and the peripheral wall of the mold.

22. The apparatus of claim 13 further comprising means for clamping the vacuum box and the refractory shield together.

23. The apparatus of claim 13 wherein the refractory shield is molded in-situ about the second mold portion.

* * * * *

UNITED STATES PATENT AND TRADEMARK OFFICE

CERTIFICATE OF CORRECTION

PATENT NO. : 5 174 356

DATED : December 29, 1992

INVENTOR(S) : A. Dean VANDERJAGT

It is certified that error appears in the above-identified patent and that said Letters Patent is hereby corrected as shown below:

Column 9, line 9; replace "gas impermeable" with ---gas-permeable---.

Column 9, line 27; replace "Claim I" with ---Claim 1---.

Signed and Sealed this

Ninth Day of November, 1993

*Attest:*

*Attesting Officer*

BRUCE LEHMAN

*Commissioner of Patents and Trademarks*